US007287661B2

(12) United States Patent
Knutsson et al.

(10) Patent No.: US 7,287,661 B2
(45) Date of Patent: Oct. 30, 2007

(54) BULK CONTAINER ASSEMBLY

(75) Inventors: Anders Knutsson, Fjalkinge (SE); Kurt Ljungbeck, Tyringe (SE)

(73) Assignee: Arca Systems, AB, Perstorp (SE)

( * ) Notice: Subject to any disclaimer, the term of this patent is extended or adjusted under 35 U.S.C. 154(b) by 753 days.

(21) Appl. No.: 10/490,047

(22) PCT Filed: Sep. 10, 2002

(86) PCT No.: PCT/SE02/01621

§ 371 (c)(1),
(2), (4) Date: Apr. 26, 2004

(87) PCT Pub. No.: WO03/024815

PCT Pub. Date: Mar. 27, 2003

(65) Prior Publication Data

US 2004/0238400 A1 Dec. 2, 2004

(30) Foreign Application Priority Data

Sep. 19, 2001 (SE) ..... 0103120

(51) Int. Cl.
*B65D 6/18* (2006.01)

(52) U.S. Cl. ..... 220/7

(58) Field of Classification Search ..... None
See application file for complete search history.

(56) References Cited

U.S. PATENT DOCUMENTS 5,622,276 A * 4/1997 Simmons ..... 220/6
6,029,839 A * 2/2000 Mansouri ..... 220/4.31
6,955,273 B2 * 10/2005 Hartwall ..... 220/1.6

FOREIGN PATENT DOCUMENTS

DE 3820999 1/1989
EP 0285953 10/1988
WO 9509110 4/1995
WO 9731832 9/1997

OTHER PUBLICATIONS

International Search Report dated Dec. 30, 2002.

* cited by examiner

*Primary Examiner*—Stephen J. Castellano
(74) *Attorney, Agent, or Firm*—Stevens, Davis, Miller & Mosher LLP

(57) ABSTRACT

Collapsible bulk container (1) which includes a carrying base member (2) provided with skids (20), collapsible side walls (3) and a removable lid (5). The side walls (3) are moveably attached to the base member. The lid (5) is provided with an outer rim (51) and an inner rim (52). Two first opposite side walls (31 and 32 respectively) are provided with coupling means (35) protruding perpendicularly from the outside face of said first side walls (31 and 32 respectively) and being arranged adjacent to the vertical edges of said first side walls (31 and 32 respectively). Two opposite second side walls (33 and 34 respectively) are provided with coupling rim (37) arranged perpendicularly on the rear face, along both vertical edges of said second side walls (33 and 34 respectively). Receiving coupling means (36) are arranged on the inside face of said coupling rim (37) protruding parallel to the rear face of said second side walls (33 and 34 respectively) and which receiving coupling means (36) are intended to interact with said coupling means (35) of said first side walls (31 and 32 respectively). The rear face of said second side walls (33 and 34 respectively) are further provided with recesses (37) adjacent to the two vertical edges while the vertical edges of said first side walls (31 and 32 respectively) are provided with heels (38) which heels (38) are intended to interact with said recesses (38). The outer rim (51) and inner rim (52) of said lid (5) are arranged so that they limit any inwards and outwards movement of erected side walls (3) when said lid (5) is assembled on said side walls (3).

17 Claims, 3 Drawing Sheets

BULK CONTAINER ASSEMBLY

Figure 1:
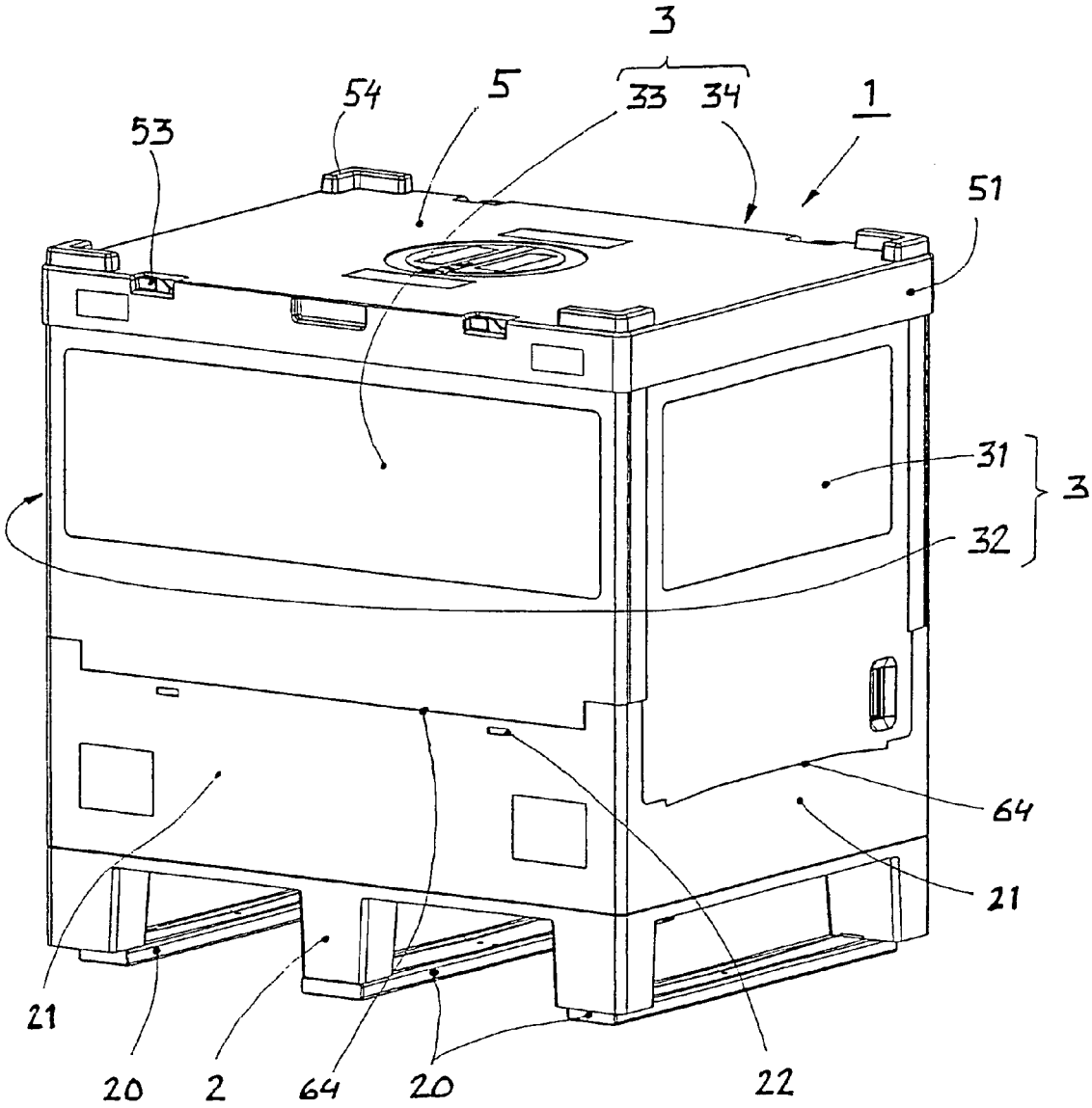

This application is a §371 Application of International Application No. PCT/SE02/01621, filed on Sep. 10, 2002, claiming the priority of Swedish Application No. 0103120-2, filed Sep. 19, 2001, the entire disclosure of which is incorporated herein by reference in its entirety.

The present invention relates to a collapsible bulk container with a removable lid, which is used together with a so-called liner in the form of a bag shaped inner layer for the transport and storage of liquid, paste and particle goods.

Collapsible containers of pallet container type are a popular type of containers due to the considerable reduction of the return transport volume. Collapsible containers are advantageously manufactured of thermoplastic material which gives light and yet sturdy containers with surfaces that are easy to keep clean. Thermoplastic containers do furthermore have the advantage that the tare weight doesn't change which is the case with for example wood containers where the tare weight might double if the wood becomes wet. Further advantages is that thermoplastics doesn't corrode, as everyone knows, which is the case with containers made of metal such as aluminium and steel. Most thermoplastic materials does furthermore have a good resistance towards chemicals such as for example acids and alkali which not could be said to be the case with wood or metals.

Handling of bulk goods is separated from case goods by the fact that it can be poured, pumped or ladled while case goods most often is picked. Mineral water can serve as an example of the differences between the two types of goods. The mineral water could either be supplied in tanks for pumping and pouring which would be regarded as bulk handling, or in bottles or cans, which would be regarded as case handling. As further examples of substances that can be bulk handled can be mentioned, fluid substances with various viscosity, particles, powders, grain, granulate or paste-like substances. Such substances can be further exemplified as chemicals for industrial use, semifinished and finished products within the food industry, petrochemical products such as oil, fuels and coal as well as plastic granulate.

Sealing problems between the different parts of the collapsible container will inevitably occur when handling powder, smaller particles and fluids. These sealing problems are most easily overcome by using a so-called liner which is placed on the inside of the erected container. This liner is advantageously given the shape of a completely closed bag with the same shape as the inner volume of the container.

The liner is suitably provided with a filling socket at the upper side and an emptying socket at the lower side. The container must of course also be provided with a hole at the lower end making the emptying socket accessible. A further advantage with a liner, besides solving the sealing problems, are that it becomes easy to meet high hygienic demands.

Through the present invention a novel bulk container with a removable lid has been achieved. Accordingly the invention relates to a collapsible bulk container, in the form of a pallet container, for the transport and storage of fluent and particle gods. The container includes a carrying base member which is provided with skids, collapsible side walls, preferably a so called liner in the form of a bag shaped inner layer and a removable lid. The side walls are moveably attached to the base member via hinges and that adjacent side walls locks together mechanically. The invention is characterised in that the lid is provided with an outer rim and an inner rim. Two first opposite side walls are provided with coupling means protruding perpendicularly from the outside face of said first side walls and being arranged adjacent to the vertical edges of said first side walls. Two opposite second side walls are provided with coupling rims arranged perpendicularly on the rear face, along both vertical edges of said second side walls. Receiving coupling means are arranged on the inside face of said coupling rim protruding parallel to the rear face of said second side walls. These receiving coupling means are intended to interact with said coupling means of said first side walls. The rear face of said second side walls are further provided with recesses adjacent to the two vertical edges while the vertical edges of said first side walls are provided with heels which heels are intended to interact with said recesses. The outer rim and inner rim of said lid are arranged so that they limit any inwards and outwards movement of erected side walls when said lid is assembled on said side walls.

According to a preferred embodiment of the invention the lid is provided with locking means for locking said lid to the side walls. The locking means are preferably provided with a manoeuvring handle, a vertically arranged pivot axle and a locking clutch. The side walls are provided with slots intended to interact with said locking clutch whereby said locking means is operated by turning motion. The length of the pivot axle, the distance from the upper edge of the side walls to the slots and the height of the outer rim are suitably adapted so that said slots are hidden by the outer rim when the lid is assembled on the erected side walls. Upwards extending side wall supports of the base member are suitably provided with lower slots allowing the lid to be locked by means of said locking means of said lid and the lower slots to the base member when the side walls are in stowed in folded position. The lid is suitably also provided with hole in which a sealing pin may be inserted. This hole is suitably arranged so that the manoeuvring handle becomes blocked by the sealing pin making it impossible to open the container without breaking the seal. Due to the design of the container and the lid, this seal is applicable on both folded and erected containers.

It is according to an alternative embodiment of the invention possible to replacing the slots of the side walls with upwards extending locking pins, adapted to reach through holes in the lid. The locking pins are then to be engaged by a groove in the manoeuvring handle. The locking pins engages said groove by turning motion. This feature will make angle between adjacent side walls slightly flexible. This flexibility will reduce the risk of collapse between the different parts of the container. Such a collapse may be caused by different locking means and hinges etc. breaking when fluid contents of the container create shock waves during bumpy transport. These problems and further means of avoiding them is also dealt with in following parts of the present technical description.

According to a special embodiment of the invention the lid is provided with a resilient section. This resilient section is most preferably constituted by a larger section in the centre of the lid which is made resilient by having thinner goods thickness than the rest of the lid, or by being provided with one or more bellowed sections, all adapted to allow a restricted vertical movement of the resilient section. The purpose of the resilient section is to dampen shock waves in fluent contents of the container. Such shock waves occurs for example when the container is dropped and also during bumpy transports and may cause great stress on the container which may collapse.

According to one embodiment of the invention the side walls are provided with angular recesses at the lower edges, each angular recess having a horizontal edge and two vertical edges. Pivot axles, which extends horizontally, are arranged on each of the vertical edges, adjacent the lower edge. A locking hatch is furthermore arranged on the horizontal edge, said locking hatch extending mainly vertical from said horizontal edge and having a locking heel applied adjacent to its free end. The base member is provided with pockets, the pockets having openings facing inwards and upwards and two vertical surfaces being arranged perpendicularly to the inside face of the side wall. Said vertical surfaces are provided with a vertical groove arranged adjacent to the front face of the side wall, said vertical groove changing direction at the bottom of the vertical groove so that it extends inwards. The vertical grooves, pivot axles, vertical surfaces and vertical edges are arranged to interact. A narrow vertical groove is furthermore arranged on the base member, and which narrow vertical groove is provided with a locking rib arranged to interact with said locking hatch and said locking heel.

The side walls of the collapsible bulk container are suitably constituted by an inner an outer layer between which one continuous or several separated hollow spaces are arranged. One or more reinforcing beams are suitably arranged in the hollow space or in one or more of the hollow spaces. Such a reinforcing beam may be made of metal, such as aluminium or steel, but may also be made of a thermoplastic material, such as a polyolefin or polyamide which possibly is filled with a reinforcing material such as glass fibre, carbon fibre or aramide fibre. It is also possible to use wood as a reinforcement in the hollow space or hollow spaces. The hollow spaces can also be filled with polymeric foam with an average density in the range 50-500 kg/m$^3$, which foam for example is constituted of polyurethane or a polyolefine. The filling with foam may be a complement to reinforcing beams as well as an alternative thereto.

Side walls according to selected embodiments of the invention can be achieved by injection moulding the inner and outer layer separately from a thermoplastic material The layers are joined to each other after the injection moulding through means of welding, screws, rivets or snap joining.

The inner and outer layers may alternatively be manufactured by vacuum moulding sheet shaped thermoplastic work pieces, which layers are joined together while the material is still hot. It is also possible to manufacture the inner and outer sheets as a simultaneous whole through blow moulding of a thermoplastic material. It is possible to achieve side walls with mainly plane outer surfaces through the described process.

Collapsible container according to above are preferably manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene-copolymer, polyamide, polycarbonate or the like. They are suitably manufactured through injection moulding, vacuum moulding, blow moulding or combinations thereof. Since the desired material characteristics of the different parts that the container is made up of can vary from part to part it is possible to add different additives to the thermoplastic material that will make this possible. As examples of such known additives can be mentioned ethylene-vinyl-acetate and rubber beads which will make the material more ductile and more impact resistant or glass fibre, carbon fibre, steel fibre or aramide fibre which will make the material more rigid but on the other hand more brittle.

The invention is described further in connection to enclosed figures showing different embodiments of the invention whereby, FIG. 1 shows a collapsible bulk container 1 according to the invention.

Figure 2:
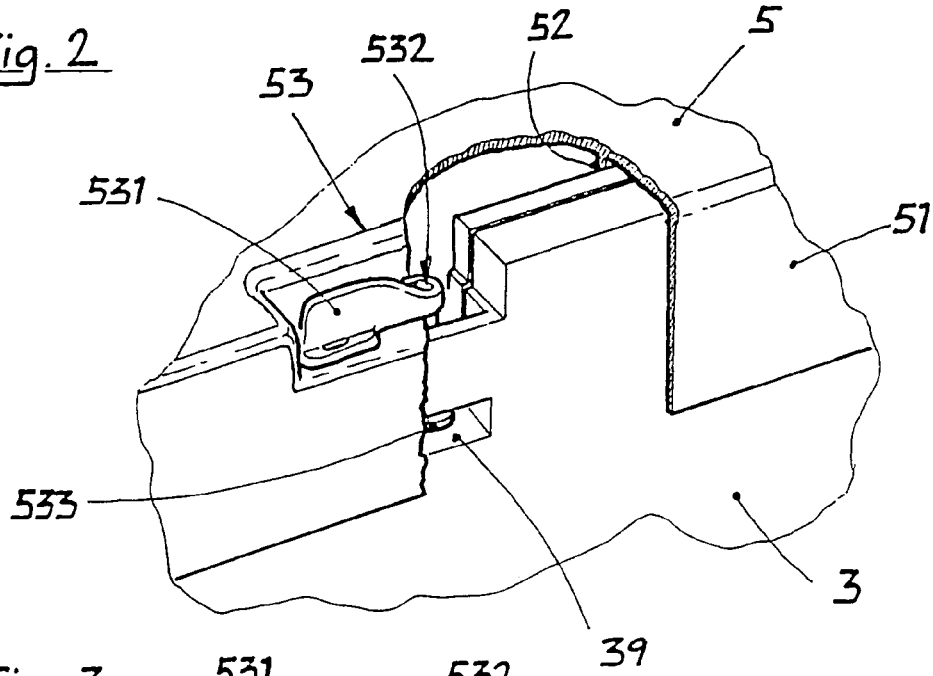

FIG. 2 shows an upper part of a collapsible bulk container 1 according to the invention where locking means 53 are used for locking a lid 5 onto side walls 3.

Figure 3:
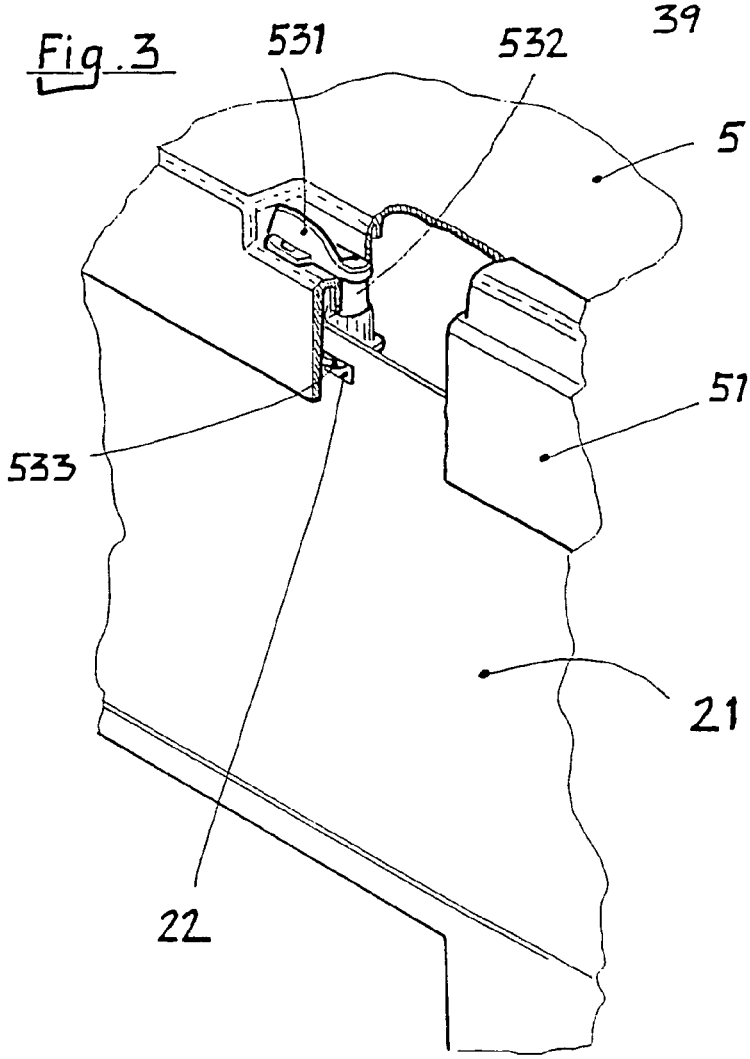

FIG. 3 shows an lower part of a collapsible bulk container 1 according to the invention where locking means 53 are used for locking a lid 5 onto a base member 2 when side walls 3 are folded.

Figure 4:
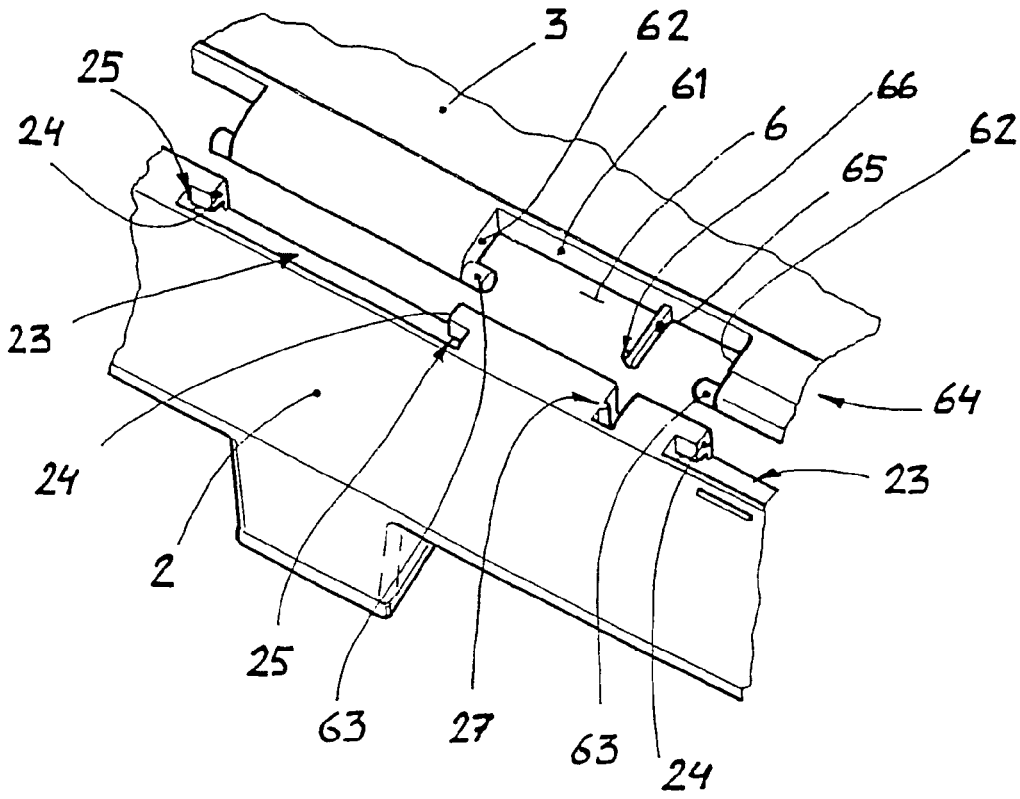

FIG. 4 shows a lower part of a collapsible bulk container 1 according to the invention where side walls 3 are hinged to a base member 2.

Figure 5:
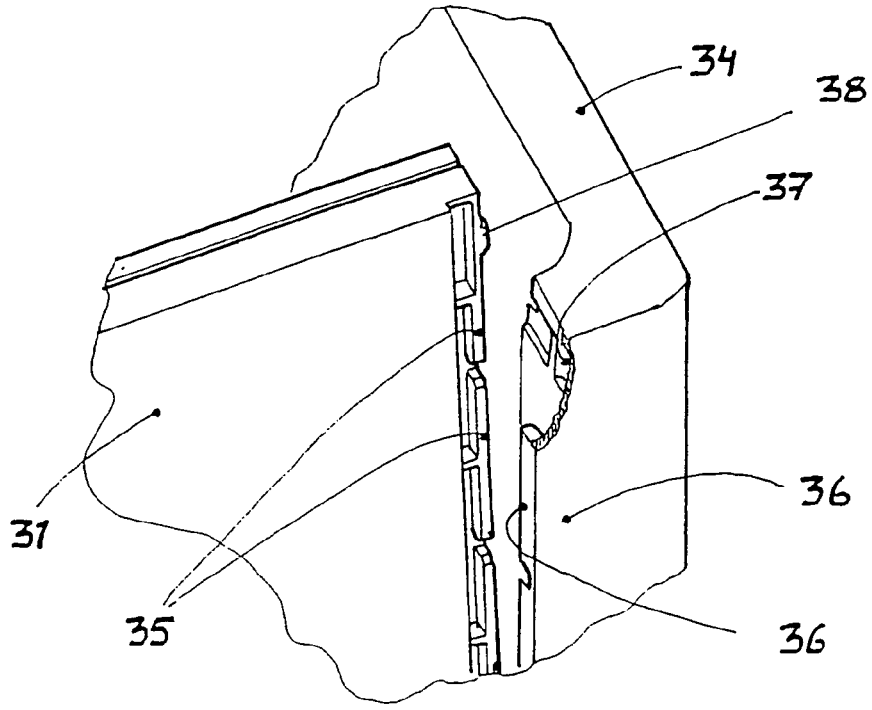

FIG. 5 shows an upper part corner of a collapsible bulk container 1 according to the invention where two adjacent side walls 31 and 34 respectively are locked together.

Accordingly, FIG. 1 shows a collapsible bulk container 1 according to the invention. The collapsible bulk container 1 is shaped as a pallet container and is used for transport and storage of fluent and particle gods. The container 1 includes a carrying base member 2 which is provided with skids 20, collapsible side walls 3, preferably a so called liner in the form of a bag shaped inner layer and a removable lid 5. The side walls 3 are moveably attached to the base member via hinges and adjacent side walls 3 locks together mechanically. The lid 5 is provided with an outer rim 51 and an inner rim 52 (see FIG. 2). Two first opposite side walls 31 and 32 respectively are provided with coupling means 35 (see FIG. 5) protruding perpendicularly from the outside face of said first side walls 31 and 32 respectively. The coupling means 35 are arranged adjacent to the vertical edges of said first side walls 31 and 32 respectively. Two opposite second side walls 33 and 34 respectively are provided with coupling rims 36 (see FIG. 5) arranged perpendicularly on the rear face, along both vertical edges of said second side walls 33 and 34 respectively. Receiving coupling means 36' (see FIG. 5) are arranged on the inside face of said coupling rim 36 protruding parallel to the rear face of said second side walls 33 and 34 respectively. The receiving coupling means 36' are intended to interact with said coupling means 35 of said first side walls 31 and 32 respectively. The rear face of said second side walls 33 and 34 respectively are further provided with recesses 37 (see FIG. 5) adjacent to the two vertical edges while the vertical edges of said first side walls 31 and 32 respectively are provided with heels 38 (see FIG. 5) which heels 38 are intended to interact with said recesses 37. The outer rim 51 and inner rim 52 of said lid 5 are arranged so that they limit any inwards and outwards movement of erected side walls 3 when said lid 5 is assembled on said side walls 3.

The base member 2 may, as an alternative to skids 20, be provided with feet (not shown). It is here suitable to have each of the two long sides of the container 1 provided with two, one on each of the two sides, slightly elongated feet moulded in one piece with the lower part of the base member 2. In each of the four corners it is suitable to provide the container 1 with feet (not shown) having a mainly square cross-section. As these corner feet are exposed to a great amount of thrusts and other force, since containers according to the present invention is commonly handled with fork lifts on occasion, they are suitably made of an inner pillar moulded in one piece with the lower portion of the base member 2. They are then provided with an outer structure which are fastened by any known means on to the central pillars thereby reinforcing the corner feet. These outer structures of the corner feet will then absorb most of the energy thereby protecting the central pillar. The outer structure may then easily be replaced if permanently damaged.

Also the short side edges, and in some cases also the long side edges, of the container 1 may be provided with this type of replaceable feet. A container with the described set of feet will also be easier to access from all four directions with a fork lift which is an advantage.

The two part foot will also make it possible to use a rigid material which will withstand load for long times without deforming. Such materials are normally rather brittle and have reduced strength against impact. The outer structure may be made of a more elastic material which will better cope with the impact of a for example a fork tine. A damaged outer structure is anyhow easily replaced should an accident occur.

The two-part feet are suitably provided with some type of gasket so that they become watertight when called for. For example food industry do not accept such pockets where water can be captured as germs may grow here.

It has furthermore shown advantageous not to apply a foot in the centre of the container 1 base. By avoiding such a foot the base is allowed to warp without turning the, now avoided, central foot into a pivot axle, around which the container may be spinned. It is also an advantage during transport where containers are stacked on top of each other. As described in the present application the lid is provided with a resilient section which has the purpose of dampening sudden shock waves caused during transport. Such shock waves may otherwise cause the container 1 to break. The absence of a central foot will allow room for the resilient section to momentarily move upwards without being obstructed by such a foot.

The lid 5 is also provided with locking means 53 for locking said lid 5 to the side walls 3. The locking means 53 are provided with a manoeuvring handle 531 (see FIGS. 2 and 3), a vertically arranged pivot axle 532 (see FIGS. 2 and 3) and a locking clutch 533 (see FIGS. 2 and 3). The side walls 3 are provided with slots 39 (see FIG. 2) intended to interact with said locking clutch 533 whereby said locking means 53 is operated by turning motion. The length of the pivot axle 532, the distance from the upper edge of the side walls 3 to the slots 39 and the height of the outer rim 51 are adapted so that said slots 39 are hidden by the outer rim 51 when the lid 5 is assembled on the erected side walls 3. Upwards extending side wall supports 21 (see also FIG. 3) of the base member 2 are provided with lower slots 22 (see FIG. 3) allowing the lid 5 to be locked by means of the locking means 53 and the lower slots 22 to the base member 2 when the side walls 3 are stowed in folded position.

According to one embodiment of the invention the lid 5 is provided with recess shaped in such a way that the manoeuvring handle 531 is at all times inside the outer edge of the lid 5. In this way the manoeuvring handle 531 is protected from being accidentally damaged. The locking means 53 may further be provided with a snapping web arranged so that it snaps between its two positions of locked and unlocked. Through this means the locking means 53 will not accidentally open as an effect of vibrations during transport.

The lid 5 is according to one embodiment of the invention provided with upwards directed stacking locators 54 which will guide the skids 20 or feet (not shown) of a container 1 arranged on top of the lid 5. The inner edges of these stacking locators 54 are suitably bevelled or sloping, thereby guiding the container 1 to positioned thereon into the correct position.

According to one special embodiment of the invention the outer structure of the corner feet as described above are suitably made in a colour that deviates from the colour of the lid 5. This will create a contrast effect which will make it easier for fork lift operators, just to mention one, to position containers 1 on top of each other during stacking.

As described above containers 1 according to the present invention are on occasion stacked, one on top of the other. Such stacks of containers 1 are often arranged adjacent to one another. This will normally create a problem if the lid 5 is allowed to protrude outside the side walls of the container 1 as the outer rim of the lid 5 may clutch the upper edge of an adjacent stack when being lowered into position. This problem may be avoided by adding small angular ribs on the side walls. The ribs will then deflect any edged part from clutching the edge of the lid 5. The lid 5 may additionally be provided with a chamfered edge. Another way of solving the same problem is to provide the upper edges of the side walls 3 with a recess into which the lid 5 will fit. The lid 5 can hereby have its outer rim inside the outer perimeter of the container 1.

The side walls 3 are furthermore provided with angular recesses 6 (see FIG. 4) at the lower edges 64 (see FIG. 4), each angular recess 6 having a horizontal edge 61 (see FIG. 4) and two vertical edges 62 (see FIG. 4). Pivot axles 63 (see FIG. 4), which extends horizontally, are arranged on each of the vertical edges 62 adjacent the lower edge 64. A locking hatch 65 (see FIG. 4) is furthermore arranged on the horizontal edge 61, said locking hatch 65 extending mainly vertical from said horizontal edge 61 and having a locking heel 66 (see FIG. 4) applied adjacent to its free end. The base member 2 is provided with pockets 23 (see FIG. 4) the pockets 23 having openings facing inwards and upwards and two vertical surfaces 24 (see FIG. 4) being arranged perpendicularly to the inside face of the side wall 3. The vertical surfaces 24 are provided with a vertical groove 25 (see FIG. 4) arranged adjacent to the front face of the side wall 3 said vertical groove 25 changing direction at the bottom of the vertical groove 25 so that it extends inwards. The vertical grooves 25, the pivot axles 63, the vertical surfaces 24 and the vertical edges 62 are arranged to interact. A narrow vertical groove 26 (see FIG. 4) is furthermore arranged on the base member 2, which narrow vertical groove 26 is provided with a locking rib 27 (see FIG. 4) is arranged to interact with said locking hatch 65 and said locking heel 66.

The side walls 3 are constituted of an inner and outer layer and respectively, between which one continuous or several separate hollow spaces are arranged. One or more reinforcing beams may be arranged in one of the hollow spaces. Such a reinforcing beam may be made of metal, such as aluminium or steel. It is also possible to utilise a reinforcing beam made of a thermoplastic material, such as a polyolefin or polyamide which is filled with a reinforcing material such as glass fibre, carbon fibre or aramide fibre. It is also possible to use wood as a reinforcement in the hollow space or hollow spaces. The hollow spaces can also be filled with polymeric foam with an average density in the range 50-500 $kg/m^3$, which foam for example is constituted of polyurethane or a polyolefin. Side walls 3 provided with reinforcing beams may of course be filled with foam.

One great advantage with utilising such a reinforcing beam is that it can be tailor-made to counteract predetermined loads. For example, a reinforcing beam may be pre-tensioned and being provided with a specific elastic module. When the container 1 is filled, as well as during transport the content of the container 1 will cause thrusts on the side wall 3 interlocking with base and with adjacent side walls. In cases where the side wall 3 itself is to rigid these locking features are exposed to great forces which may cause them to break. On the other hand a side wall 3 made too resilient may be impossible to use as the side walls will warp when the container 1 is filled thereby making it impossible or very difficult to arrange a lid thereon. A pre-tensioned beam like the one described in the present application will make it possible to perfectly balance the warping effect of the content of a filled container without making the side walls 3 so rigid that the locking features between side walls 3 as well as between side walls 3 and base member 2 may break during sudden thrusts caused by hasty filling or bumps during transport.

The inner and outer layer are achieved by injection moulded individually from a thermoplastic material. The layers and are joined to each other after the injection moulding through means of welding. It is also possible to manufacture the inner and outer layers by vacuum moulding sheet shaped thermoplastic work pieces, which layers are joined together by being welded while the material is still hot. The inner and outer layers may alternatively be manufactured simultaneously through blow moulding of a thermoplastic material. The inner and outer layer of the side walls 3 of a container 1 according to the invention exhibits mainly plane surfaces.

The space inside the double walled structure of the side wall 3 as herein described or for that sake the base member 2 which according to a preferred embodiment of the invention also is constituted of two parts welded together thereby forming a twin walled structure, can be used for other purposes as well. It is for example possible to provide the interior of these twin walled structures with ribs arranged in such a way that channels may be formed therein, the channels being used for heating or cooling by forcing a fluidum through said channels.

It is also possible to utilise the space for applying micro chips with included transmitters, also known as smart cards. These smart cards can hold information regarding the content of the container, packing date, operator, receiver etc. and can, at any time during transport, be programmed to hold any type logistical information. It can also be provided with a GPS transponder so that it can be located at any time during transport. The micro chip may also be provided with an emergency transmitter and a sensor which may detect leaks. This option is suitable in cases where the container 1 is used for transportation of dangerous goods. The container 1 may then reveal its position, content and that a leak has occurred via a radio transmission so that proper actions may be planned.

FIG. 2 shows an upper part of a collapsible bulk container 1 according to the invention where locking means 53 are used for locking a lid 5 onto side walls 3. The lid 5 is provided with an outer rim 51 and an inner rim 52. The lid 5 is accordingly provided with locking means 53 for locking said lid 5 to the side walls 3. The locking means 53 are provided with a manoeuvring handle 531, a vertically arranged pivot axle 532 and a locking clutch 533. The side walls 3 are provided with slots 39 intended to interact with said locking clutch 533 whereby said locking means 53 is operated by turning motion. The length of the pivot axle 532, the distance from the upper edge of the side walls 3 to the slots 39 and the height of the outer rim 51 are adapted so that said slots 39 are hidden by the outer rim 51 when the lid 5 is assembled on the erected side walls 3.

FIG. 3 shows an lower part of a collapsible bulk container 1 according to the invention where locking means 53 are used for locking a lid 5 onto a base member 2 when side walls 3 are folded. The lid 5 is accordingly provided with locking means 53 for locking said lid 5 to the side walls 3 which locking means 53 is used for locking the lid 5 to the base member 2 when the side walls 3 (see FIG. 1) are stowed in folded position. The locking means 53 are provided with a manoeuvring handle 531, a vertically arranged pivot axle 532 and a locking clutch 533. Upwards extending side wall supports 21 of the base member 2 are provided with lower slots 22 which allows the lid 5 to be locked by means of the locking means 53 and the lower slots 22 to the base member 2 when the side walls 3 are stowed in folded position.

FIG. 4 shows a lower part of a collapsible bulk container 1 according to the invention where side walls 3 are hinged to a base member 2. The side walls 3 are provided with angular recesses 6 at the lower edges 64, each angular recess 6 having a horizontal edge 61 and two vertical edges 62. Pivot axles 63, which extends horizontally, are arranged on each of the vertical edges 62 adjacent the lower edge 64. A locking hatch 65 is furthermore arranged on the horizontal edge 61, said locking hatch 65 extending mainly vertical from said horizontal edge 61 and having a locking heel 66 applied adjacent to its free end. The base member 2 is provided with pockets 23 the pockets 23 having openings facing inwards and upwards and two vertical surfaces 24 being arranged perpendicularly to the inside face of the side wall 3. The vertical surfaces 24 are provided with a vertical groove 25 arranged adjacent to the front face of the side wall 3 said vertical groove 25 changing direction at the bottom of the vertical groove 25 so that it extends inwards. The vertical grooves 25, the pivot axles 63, the vertical surfaces 24 and the vertical edges 62 are arranged to interact. A narrow vertical groove 26 is furthermore arranged on the base member 2, which narrow vertical groove 26 is provided with a locking rib 27 is arranged to interact with said locking hatch 65 and said locking heel 66.

There is an advantage with the special design with a separate locking hatch 65 which will prevent the side wall 3 from unintentionally being disengaged from the base member 2. It is easy with a simple tool, like for example a screwdriver, to temporarily disengage the locking hatches 65 so that the side wall 3 may be separated from the base member 2. It will hereby be easy to replace a damaged part as well as getting access to hidden parts of the container 1 when a thorough cleaning is called for.

The special design with a separate locking hatch 65 is easy to assemble as well. The side wall is just lowered down so that the pivot axles 63 engages the vertical grooves 25. The locking hatch 65 will snap into locked position once the side wall 3 has been erected the first time and will then remain locked until tampered with as described above.

FIG. 5 shows an upper part corner of a collapsible bulk container 1 according to the invention where two adjacent side walls 31 and 34 respectively are locked together. Two first opposite side walls 31 and 32 respectively are accordingly provided with coupling means 35 protruding perpendicularly from the outside face of said first side walls 31 and 32 respectively. The coupling means 35 are arranged adjacent to the vertical edges of said first side walls 31 and 32 respectively. Two opposite second side walls 33 and 34 respectively are provided with coupling rims 36 arranged perpendicularly on the rear face, along both vertical edges of said second side walls 33 and 34 respectively. Receiving coupling means 36' are arranged on the inside face of said coupling rim 36 protruding parallel to the rear face of said second side walls 33 and 34 respectively. The receiving coupling means 36' are intended to interact with said coupling means 35 of said first side walls 31 and 32 respectively. The rear face of said second side walls 33 and 34 respectively are further provided with recesses 37 adjacent to the two vertical edges while the vertical edges of said first side walls 31 and 32 respectively are provided with heels 38 which heels 38 are intended to interact with said recesses 37.

The invention is not limited by the embodiments shown, since these can be altered in several ways within the scope of the invention.

The invention claimed is:

1. Collapsible bulk container (1), in the form of a pallet container, for the transport and storage of fluent and particle goods, which container (1) includes a carrying base member (2) which is provided with skids (20), collapsible side walls (3), preferably a so called liner in the form of a bag shaped inner layer and a removable lid (5), whereby the side walls (3) are moveably attached to the base member via hinges and that adjacent side walls (3) locks together mechanically, wherein the lid (5) is provided with an outer rim (51) and an inner rim (52) while two first opposite side walls (31 and 32 respectively) are provided with coupling means (35) protruding perpendicularly from the outside face of said first side walls (31 and 32 respectively) and being arranged adjacent to the vertical edges of said first side walls (31 and 32 respectively) and two opposite second side walls (33 and 34 respectively) are provided with coupling rims (36) arranged perpendicularly on the rear face, along both vertical edges of said second side walls (33 and 34 respectively), that receiving coupling means (36') are arranged on the inside face of said coupling rim (36) protruding parallel to the rear face of said second side walls (33 and 34 respectively) and which receiving coupling means (36') are intended to interact with said coupling means (35) of said first side walls (31 and 32 respectively), that the rear face of said second side walls (33 and 34 respectively) are further provided with recesses (37) adjacent to the two vertical edges while the vertical edges of said first side walls (31 and 32 respectively) are provided with heels (38) which heels (38) are intended to interact with said recesses (37) and that the outer rim (51) and inner rim (52) of said lid (5) are arranged so that they limit any inwards and outwards movement of erected side walls (3) when said lid (5) is assembled on said side walls (3).

2. Collapsible bulk container (1) according to claim 1, wherein the lid (5)is provided with locking means (53) for locking said lid (5) to the side walls (3).

3. Collapsible bulk container (1) according to claim 2, wherein the locking means (53) are provided with a maneuvering handle (531), a vertically arranged pivot axle (532) and a locking clutch (533), that the side walls (3) are provided with slots (39) intended to interact with said locking clutch (533) whereby said locking means (53) is operated by turning motion.

4. Collapsible container (1) according to claim 3, wherein the length of the pivot axle (532), the distance from the upper edge of the side walls (3) to the slots (39) and the height of the outer rim (51) are adapted so that said slots (39) are hidden by the outer rim (51) when the lid (5) is assembled on the erected side walls (3).

5. Collapsible container (1) according to claim 2, wherein upwards extending side wall supports (21) of the base member (2) are provided with lower slots (22) allowing the lid (5) to be locked by means of the locking means (53) and the lower slots (22) to the base member (2) when the side walls (3) are stowed in folded position.

6. Collapsible container (1) according to claim 1, wherein the side walls (3) are provided with angular recesses (6) at the lower edges (64), each angular recess (6) having a horizontal edge (61) and two vertical edges (62), that pivot axles (63), which extends horizontally, are arranged on each of the vertical edges (62) adjacent the lower edge (64), furthermore that a locking hatch (65) is arranged on the horizontal edge (61), said locking hatch (65) extending mainly vertical from said horizontal edge (61) and having a locking heel (66) applied adjacent to its free end, that the base member (2) is provided with pockets (23) the pockets (23) having openings facing inwards and upwards and two vertical surfaces (24) being arranged perpendicularly to the inside face of the side wall (3), said vertical surfaces (24) being provided with a vertical groove (25) arranged adjacent to the front face of the side wall (3) said vertical groove (25) changing direction at the bottom of the vertical groove (25) so that it extends inwards, that said vertical grooves (25), said pivot axles (63), said vertical surfaces (24) and said vertical edges (62) are arranged to interact, and furthermore that a narrow vertical groove (26), arranged on the base member (2), and which narrow vertical groove (26) is provided with a locking rib (27) is arranged to interact with said locking hatch (65) and said locking heel (66).

7. Collapsible bulk container(1) according to claim 1, wherein the side walls (3) are constituted of an inner and an outer layer between which one continuous or several separated hollow spaces are arranged.

8. Collapsible bulk container (1) according to claim 7, wherein at least one reinforcing beam is arranged in the hollow space or one of the hollow spaces.

9. Collapsible bulk container (1) according to claim 8, wherein the reinforcing beam is constituted of a metal such as aluminum or steel.

10. Collapsible bulk container (1) according to claim 8, wherein the reinforcing beam is constituted of thermoplastic material such as a polyolefin or polyamide which possibly is filled with a reinforcing material such as glass fibre, carbon fibre or aramide fibre.

11. Collapsible bulk container (1) according to claim 7, wherein the hollow space or the hollow spaces are filled with a polymeric foam with an average density in the range 50-500 $kg/m^3$, which foam, for example is constituted of polyurethane or a polyolefin.

12. Collapsible bulk container (1) according to claim 7, wherein the inner and outer layers is achieved by separately injection mold the inner and outer layer from a thermoplastic material, which layers are joined to each other after the injection molding through means of welding, screws, rivets or snap joining.

13. Collapsible bulk container (1) according to claim 7, wherein the inner and outer layers are manufactured by vacuum molding sheet shaped thermoplastic work pieces, which layers are joined together through welding while the material is still hot.

14. Collapsible bulk container (1) according to claim 7, wherein the inner and outer layers is manufactured through blow molding of a thermoplastic material.

15. Collapsible bulk container (1) according to claim 7, wherein the outer layer of the side walls (3) exhibits mainly plane outer surfaces.

16. Collapsible bulk container (1) according to claim 7, wherein the inner layer of the side walls (3) exhibits mainly plane outer surfaces.

17. Collapsible bulk container (1) according to claim 1, wherein it, in the main, is manufactured of one or more polymeric materials such as polyethylene, polypropylene, polybutene, polyvinylchloride, polyalkylene-therephtalate, acrylonitrile-butadiene-styrene-copolymer, polyamide, polycarbonate or the like through injection molding, vacuum molding, blow molding, or combinations thereof.

* * * * *